US008456263B2

(12) United States Patent
Salomäki

(10) Patent No.: US 8,456,263 B2
(45) Date of Patent: Jun. 4, 2013

(54) WINDING ARRANGEMENT FOR AN INDUCTIVE COMPONENT

(76) Inventor: Jarkko Salomäki, Tuusula (FI)

( * ) Notice: Subject to any disclaimer, the term of this patent is extended or adjusted under 35 U.S.C. 154(b) by 0 days.

(21) Appl. No.: 13/500,827

(22) PCT Filed: Oct. 8, 2010

(86) PCT No.: PCT/FI2010/050789

§ 371 (c)(1),
(2), (4) Date: Jun. 14, 2012

(87) PCT Pub. No.: WO2011/042614

PCT Pub. Date: Apr. 14, 2011

(65) Prior Publication Data

US 2012/0242442 A1 Sep. 27, 2012

(30) Foreign Application Priority Data

Oct. 9, 2009 (FI) ..... 20096045

(51) Int. Cl.
*H01F 27/10* (2006.01)

(52) U.S. Cl.
USPC ..... 336/58

(58) Field of Classification Search
USPC ..... 336/58–62, 180–184, 206–208
See application file for complete search history.

(56) References Cited

U.S. PATENT DOCUMENTS

| | | | | |
|---|---|---|---|---|
| 3,477,052 | A * | 11/1969 | Van Nice | 336/70 |
| 3,548,354 | A * | 12/1970 | Schwab | 336/57 |
| 3,702,452 | A | 11/1972 | Yannucci | |
| 4,000,482 | A * | 12/1976 | Staub et al. | 336/60 |
| 4,207,550 | A | 6/1980 | Daikoku et al. | |
| 4,943,793 | A | 7/1990 | Ngo et al. | |
| 6,081,179 | A | 6/2000 | Kato | |
| 7,719,397 | B2 * | 5/2010 | Pauley et al. | 336/55 |

FOREIGN PATENT DOCUMENTS

| | | | |
|---|---|---|---|
| EP | 2 075 805 | A1 | 7/2009 |
| JP | 61-229306 | A | 10/1986 |
| JP | 63-88809 | A | 4/1988 |

* cited by examiner

*Primary Examiner* — Tuyen Nguyen
(74) *Attorney, Agent, or Firm* — Birch, Stewart, Kolasch & Birch, LLP

(57) ABSTRACT

The scope of the invention is a winding arrangement for an inductive component that consists at least of a core (9) and of a winding structure placed around the core and consisting of planar winding sheets (11). Inside the winding structure there is cooling medium that is adapted to transfer excess heat away from the winding.

13 Claims, 16 Drawing Sheets

Prior Art

WINDING ARRANGEMENT FOR AN INDUCTIVE COMPONENT

The scope of the invention is a winding arrangement for an inductive component according to claim 1.

Inductive components consist at least of a winding and a core. In order to reduce the size of power electronics it would be very desirable that the size of the winding of an inductive component would be as compact as possible. In high frequency and low power switched mode power supplies so called planar windings are used in order to meet high power density requirements. The windings are built from substantially planar elements. Such winding can be manufactured for example by utilizing printed circuit board layers, by stacking and soldering stamped copper parts or by folding a flexible printed circuit board, such as Kapton based laminate. Disadvantage of these known planar winding techniques is that they are not suitable for high current applications due to restrictions in manufacturing process and cooling capability. For these reasons high power inductive components are manufactured using wire or foil.

Figure 1:
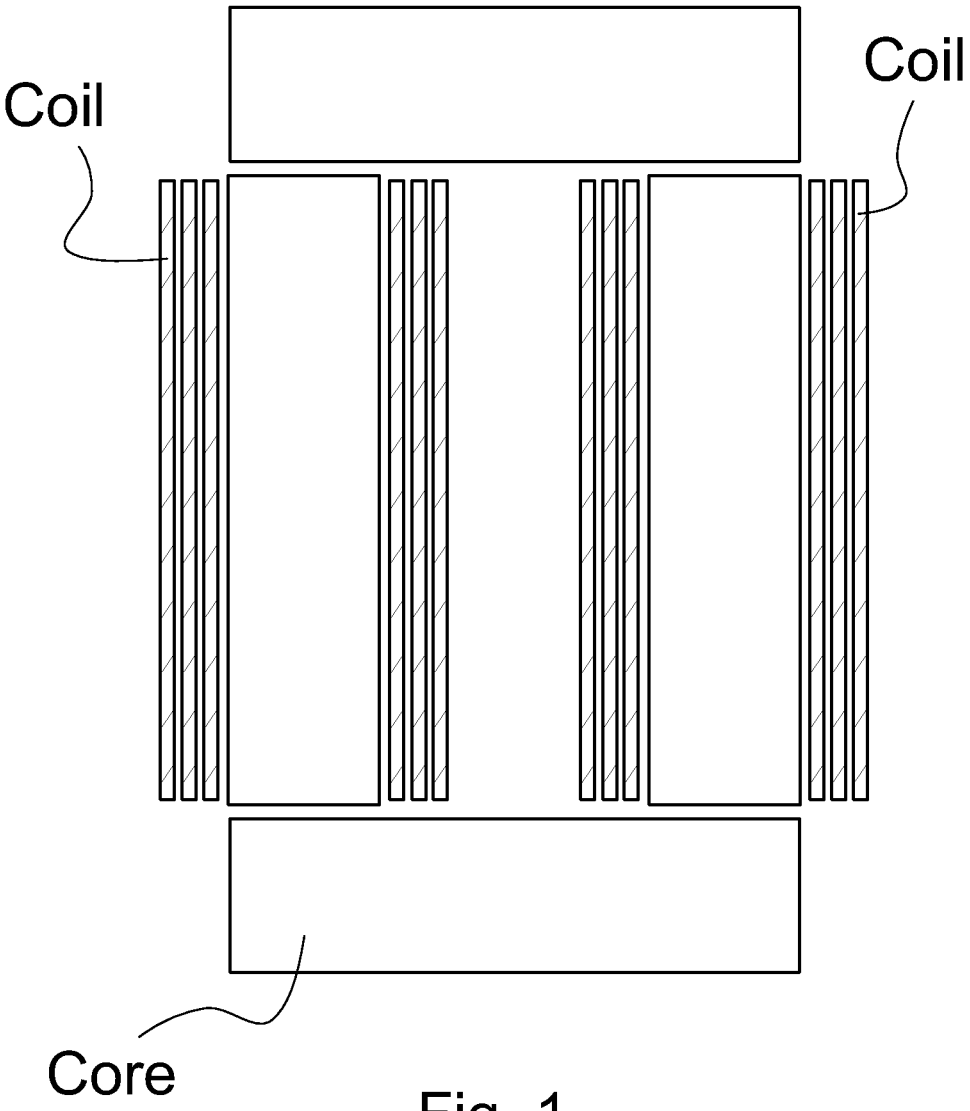

FIG. 1 presents in principle and in a simplified form an inductive component according to prior art. It's winding is manufactured by winding a foil around the core as shown in FIG. 1. In the FIG. 1 the thickness of the foil is larger than in reality and also there are some air gaps between the winding layers for the sake of clarity. In reality the layers are thin and they are side by side with each other so that in between there is only a thin insulator.

However the problem with the foil wound windings is that they have poor cooling properties. Especially in innermost winding layers hot spots are generated because heat has to conduct through all winding layers to ambient air. Another problem is that in order to reach required conductor cross-sectional area the foil has to be wide, which results that the component will be much larger in one direction than in another direction. In FIG. 1 the height of the inductive component is much higher that the width. This is not an optimum shape in terms of size minimization.

The object of the present invention is to remove the above-mentioned drawbacks and to result a simple, economic and effective winding arrangement for an inductive component, which allows high power and high current inductive components to have optimum size and shape along with effective cooling of the windings. The winding arrangement according to invention can be used with all sort of inductive components but it is especially well suited as a winding for above mentioned high power and high current inductive components. The winding arrangement according to the invention is characterized by what is presented in the characterization part of claim 1. Other embodiments of the invention are characterized by what is presented in the other claims.

Other inventive embodiments may also be presented in the description of the present application. It is also possible to define the inventive content also in a different way than how it is done in claims below. In addition it can be concluded that some features of the sub claims may in some circumstances be seen as inventive as such.

The advantage of the winding arrangement according to the invention is for example that the core losses generated inside the inductive component may be effectively transferred into the cooling medium and by that way out of the winding, which enhances the cooling. An advantage is also that because of the winding the size of the inductive component can be optimized. Winding arrangement according to the invention is especially well suited for winding inductive components purposed for high power and current levels.

Figure 4:
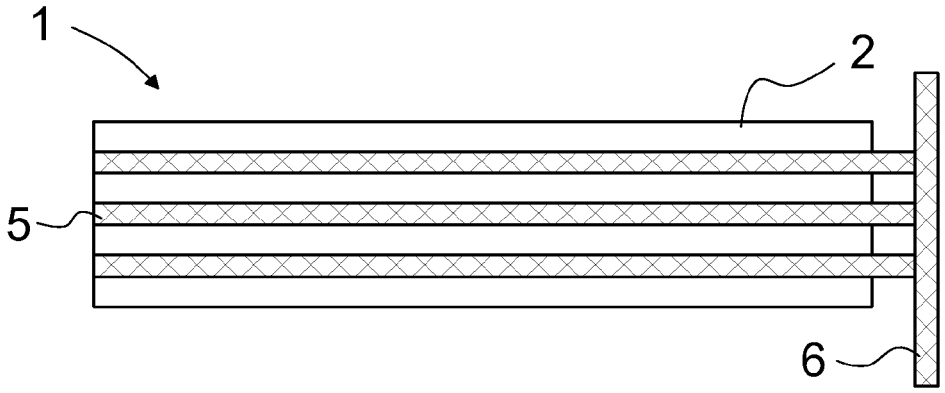
Figure 5:
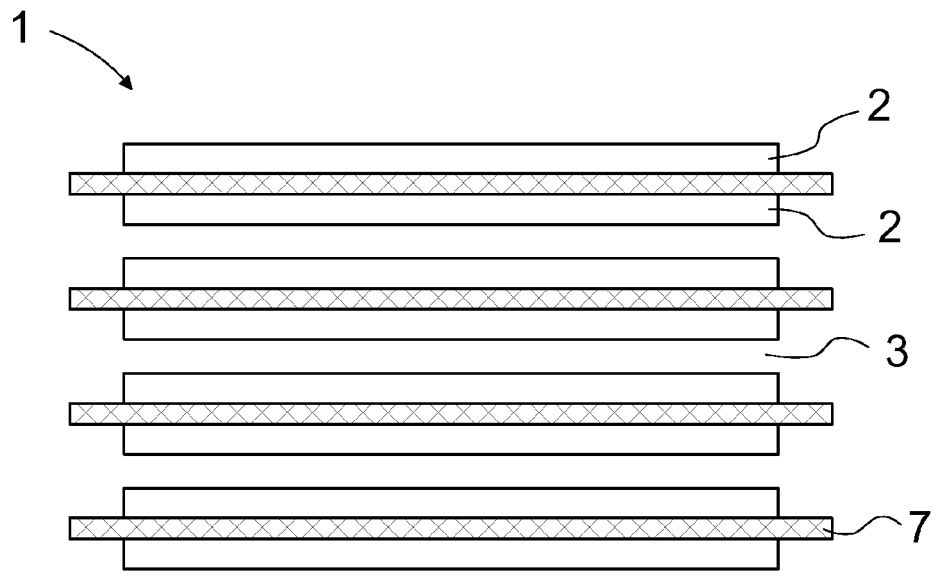
Figure 6:
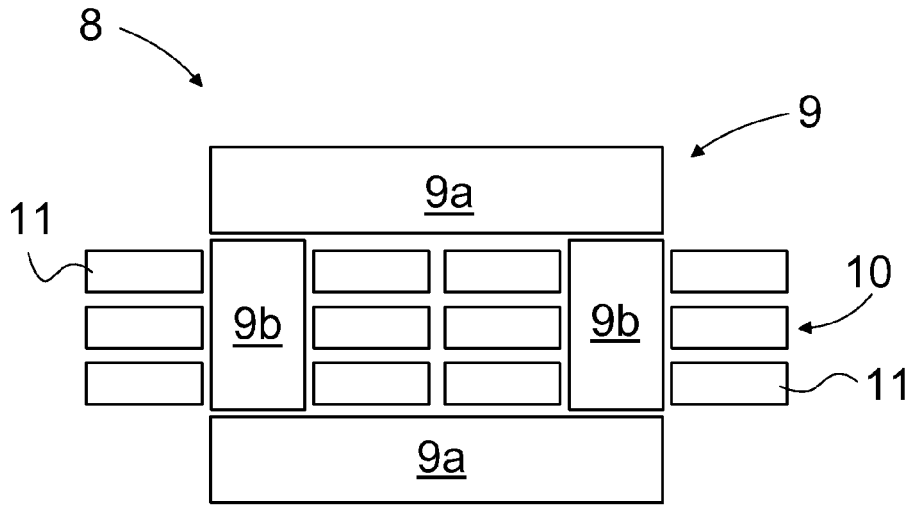
Figure 7:
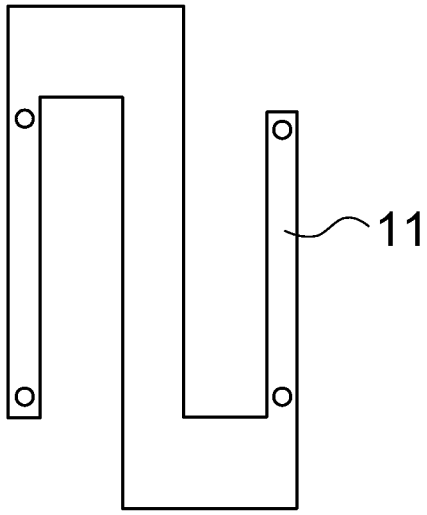
Figure 8:
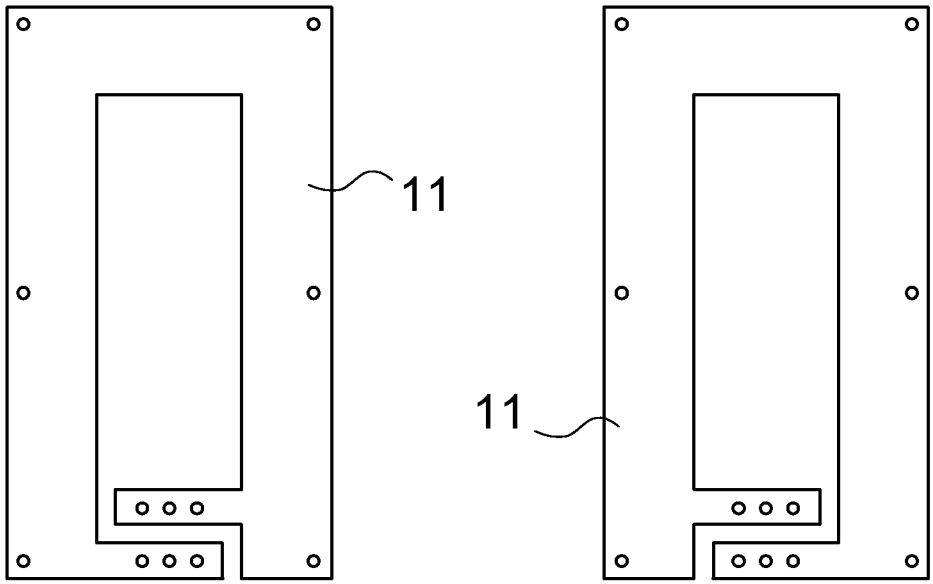
Figure 9:
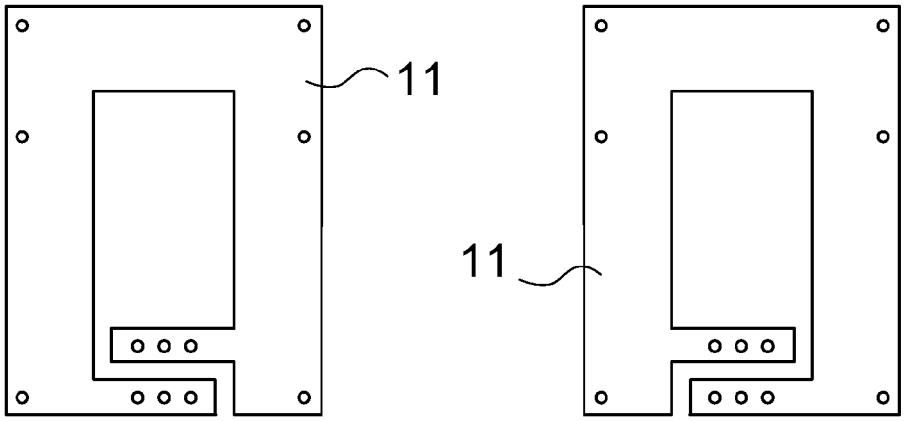
Figure 10:
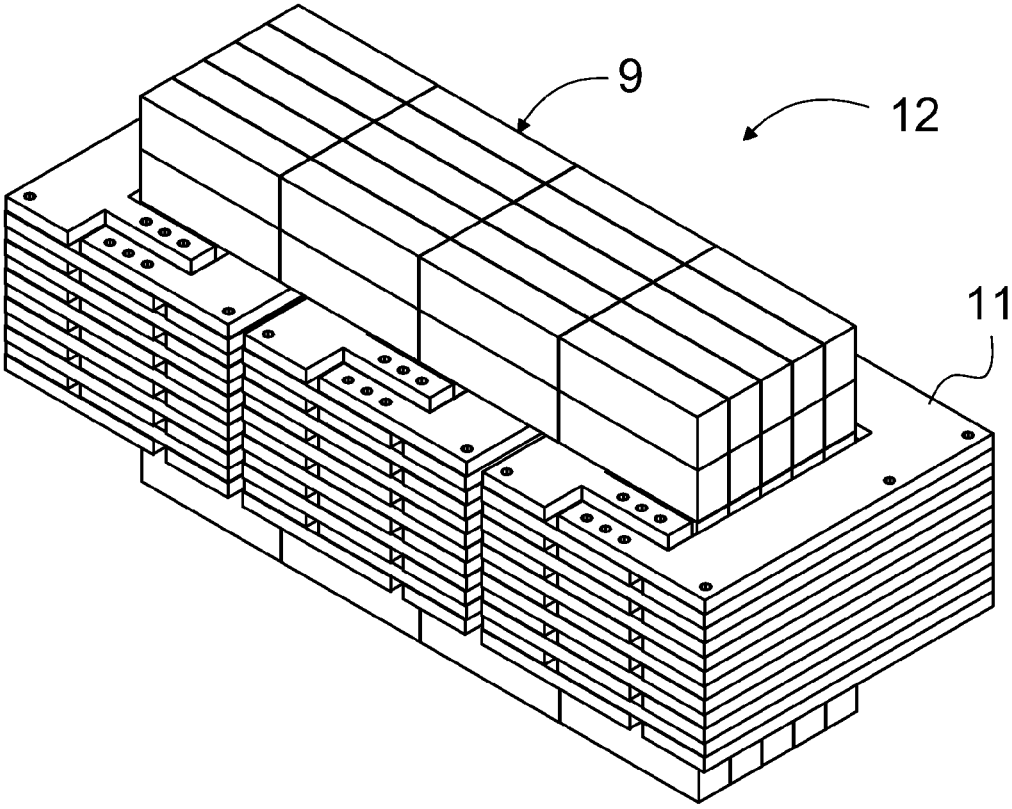
Figure 11:
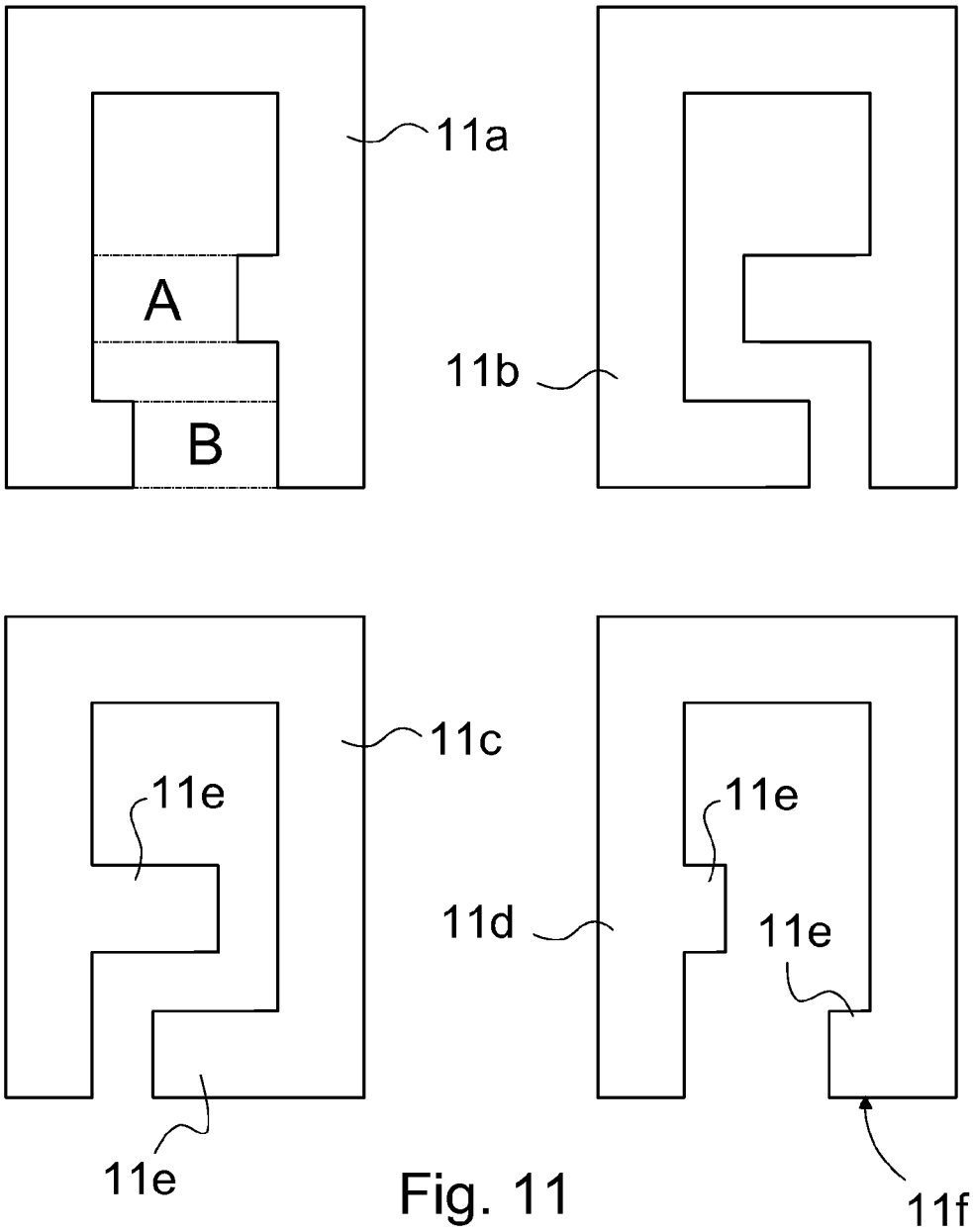
Figure 12:
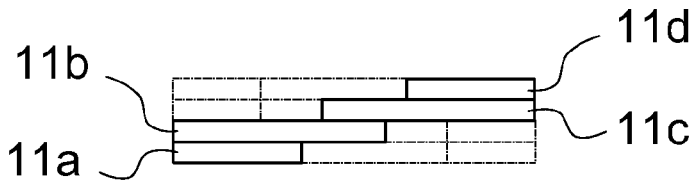
Figure 13:
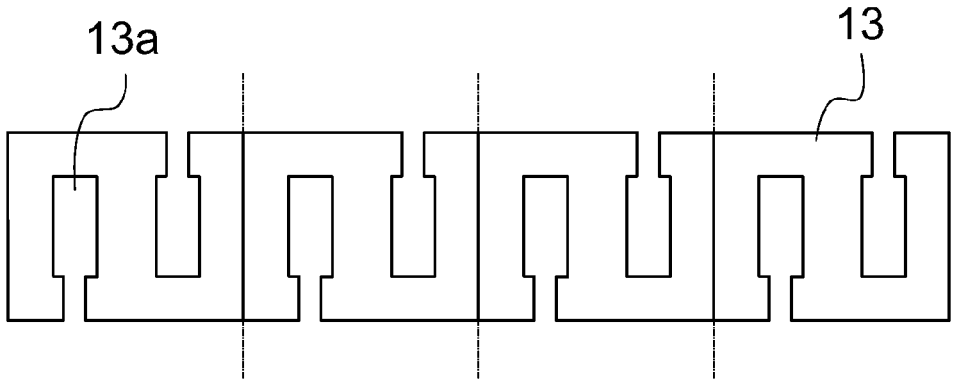
Figure 14:
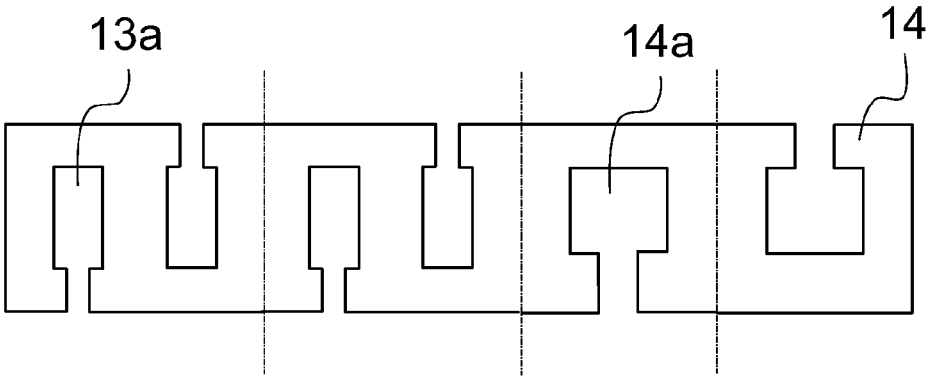
Figure 15:
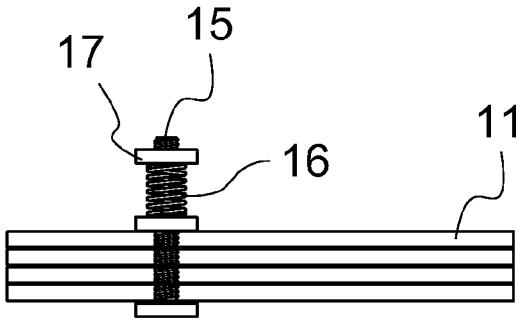
Figure 16:
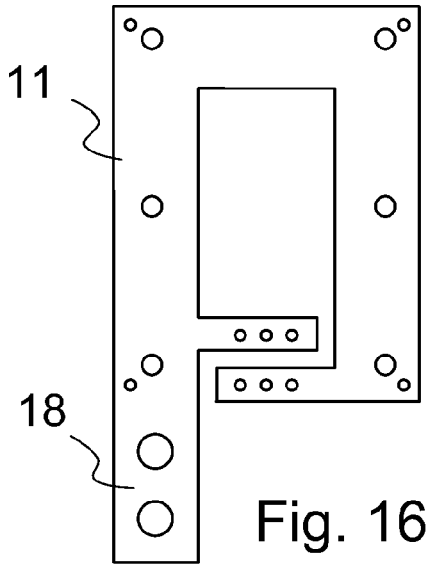
Figure 15A:
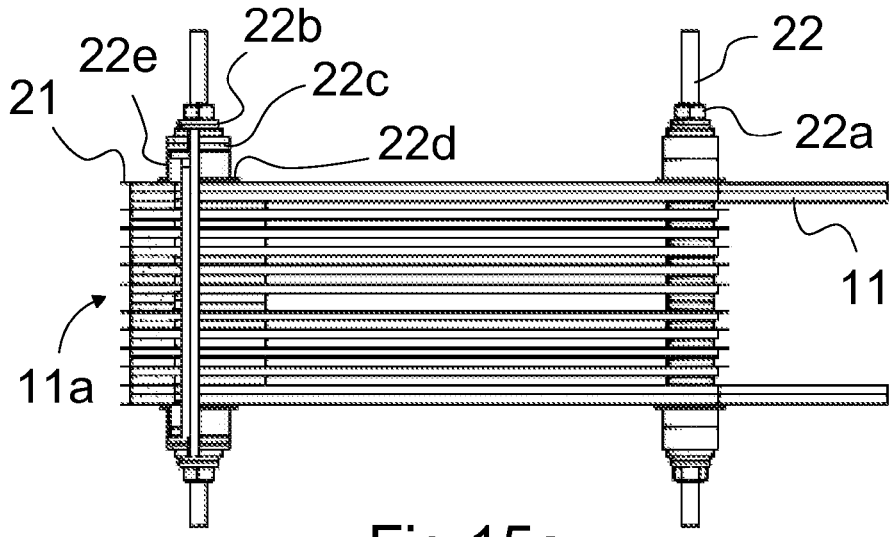
Figure 15B:
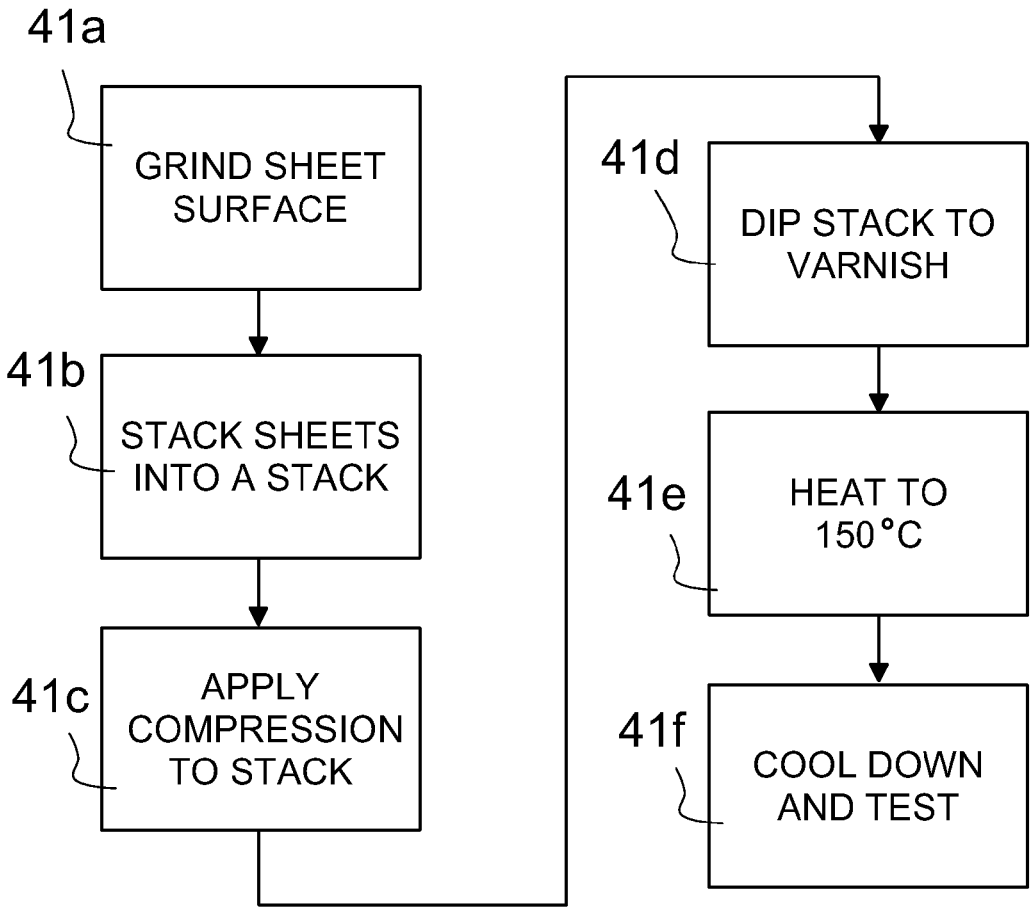
Figure 16A:
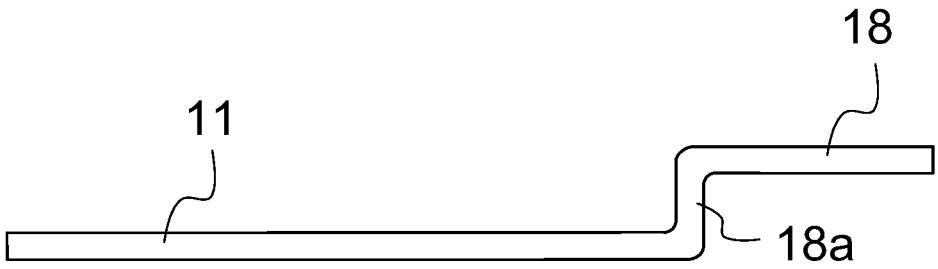
Figure 16B:
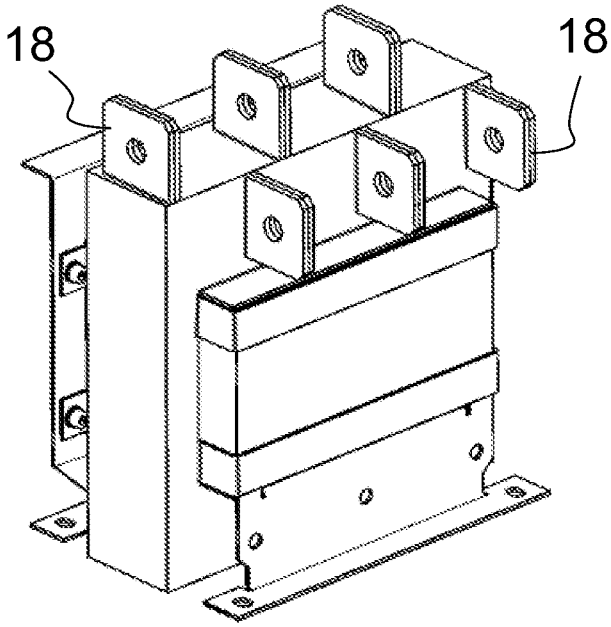
Figure 16C:
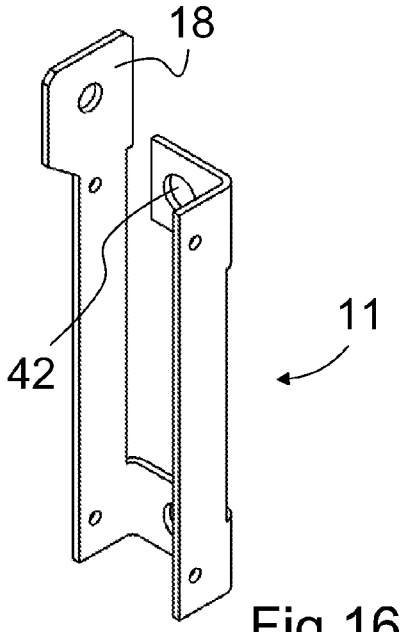
Figure 16D:
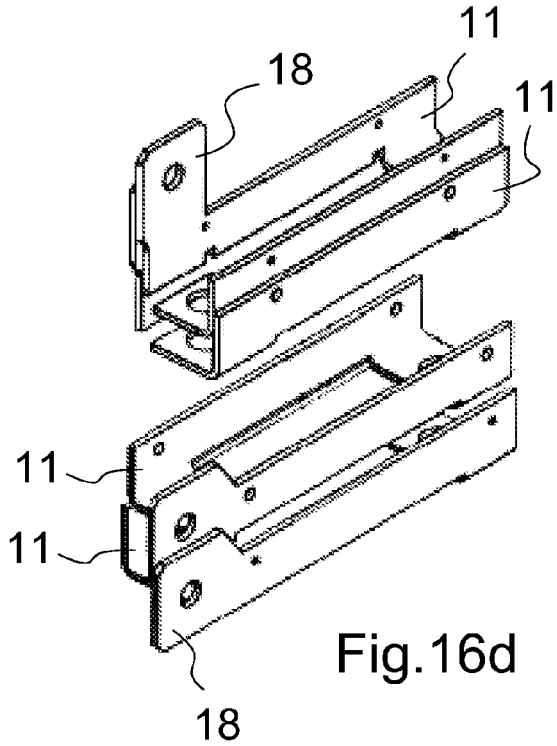
Figure 16E:
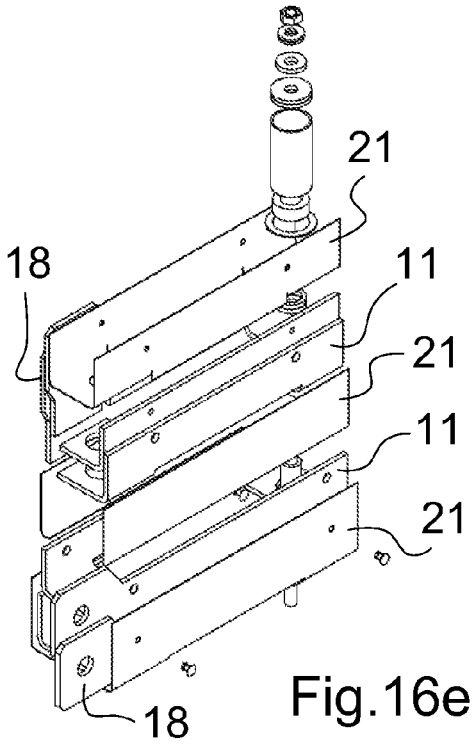
Figure 16F:
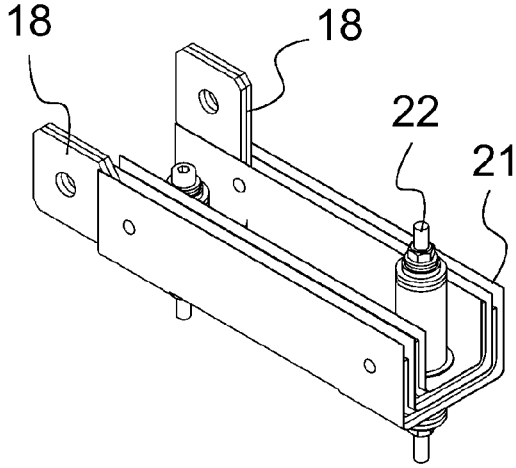
Figure 17:
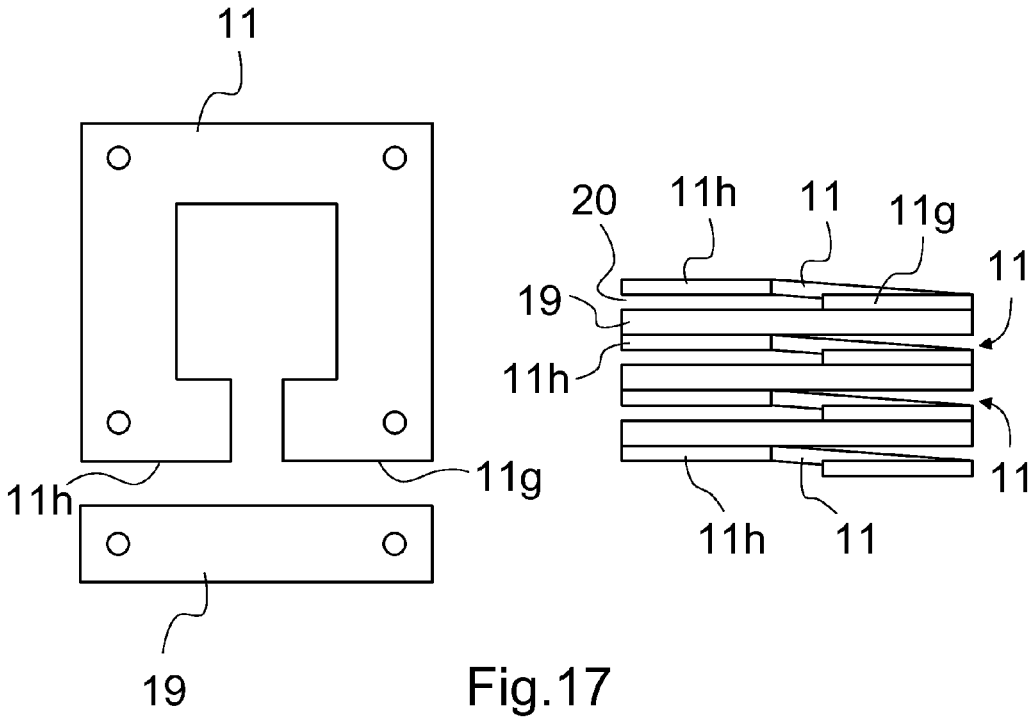
Figure 18:
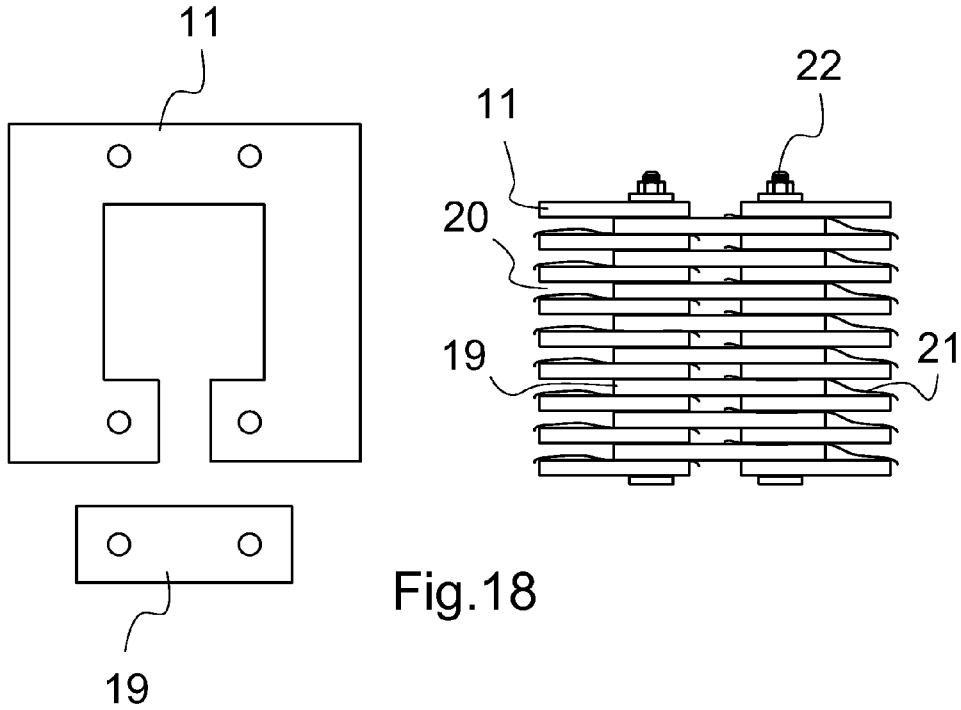
Figure 19:
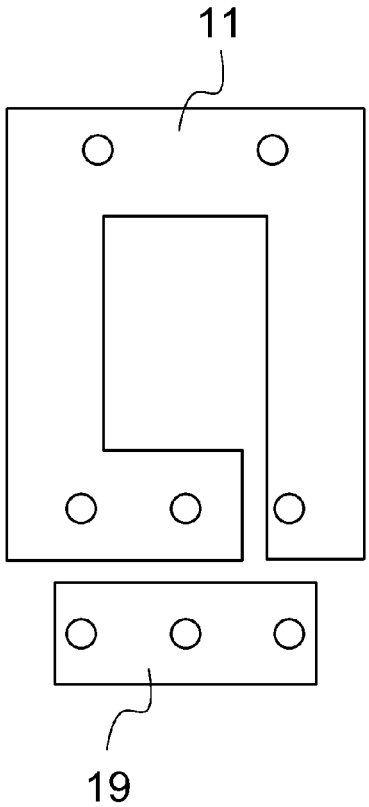
Figure 19:
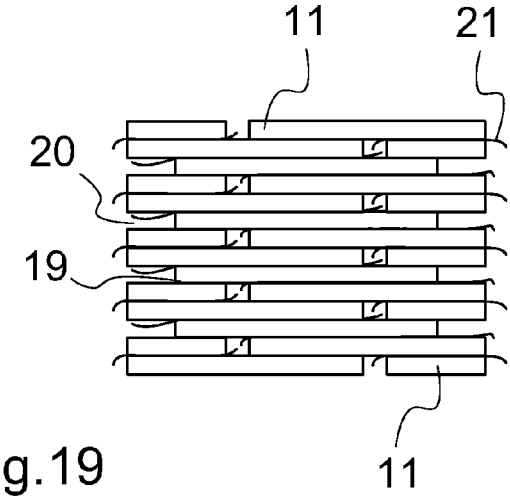
Figure 21:
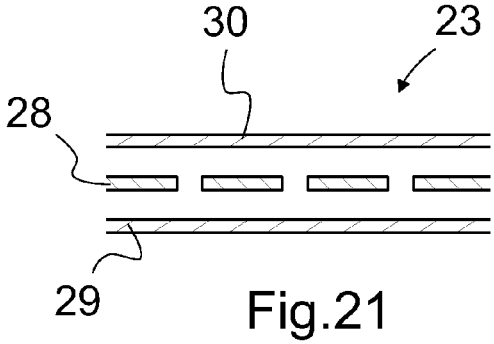
Figure 22:
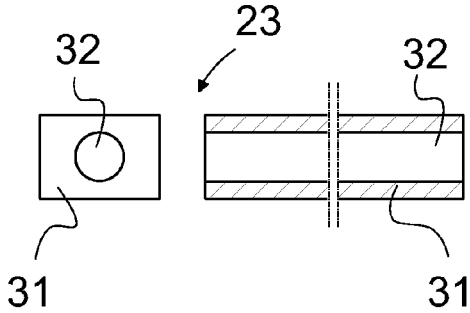
Figure 23:
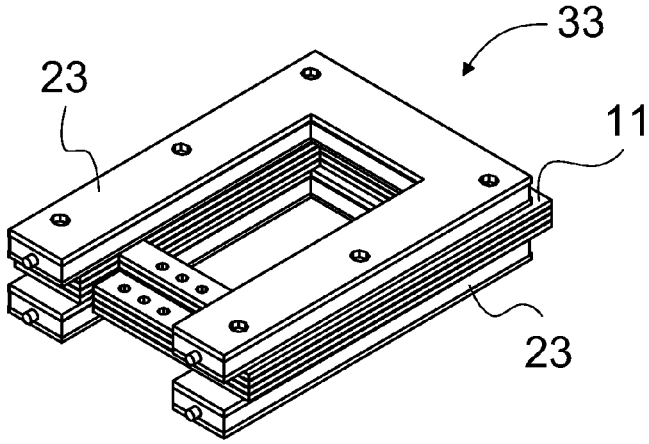
Figure 24:
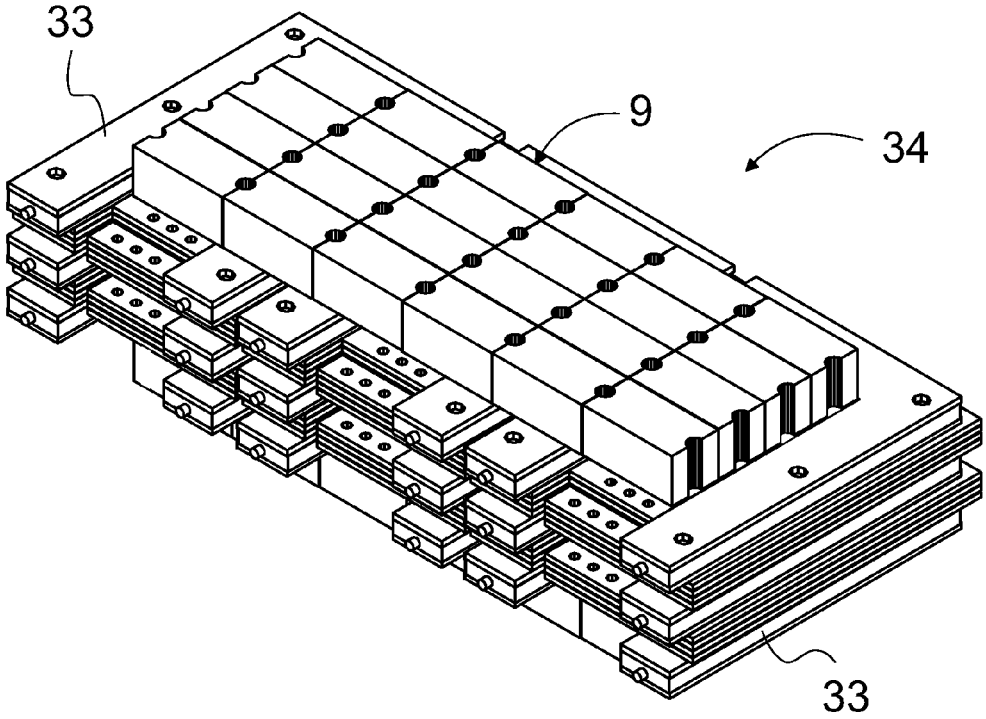
Figure 25:
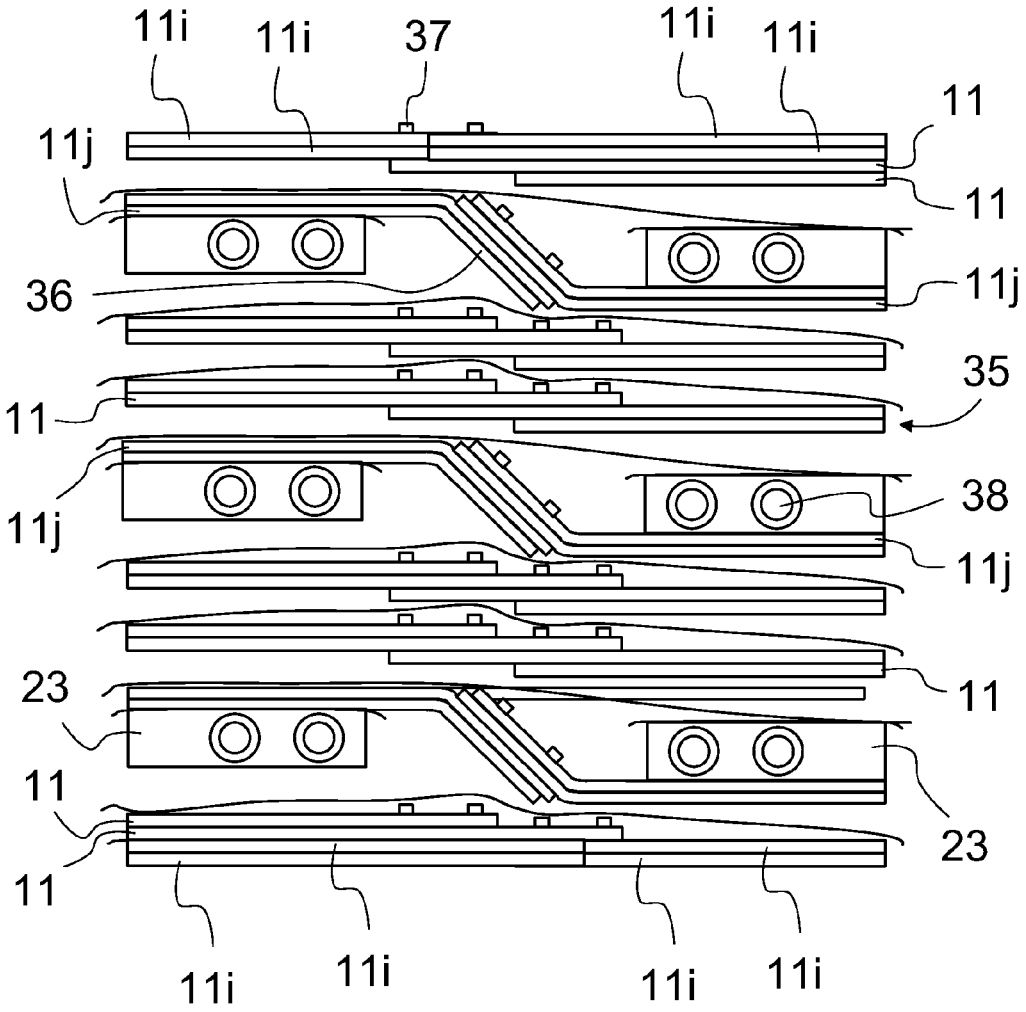
Figure 25A:
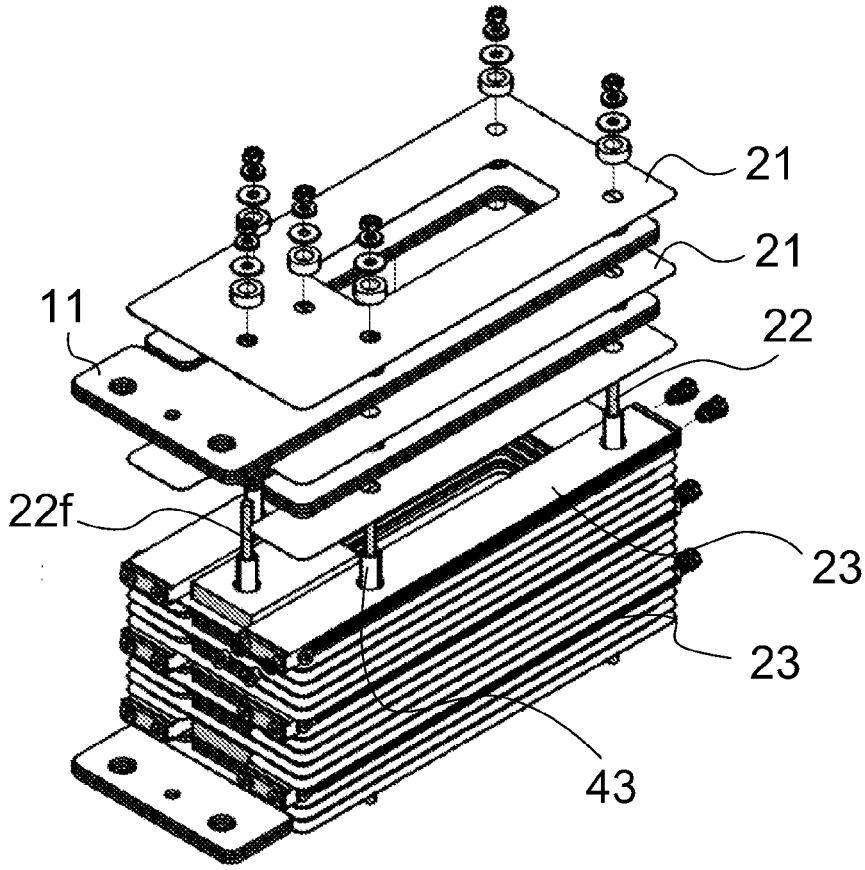
Figure 25B:
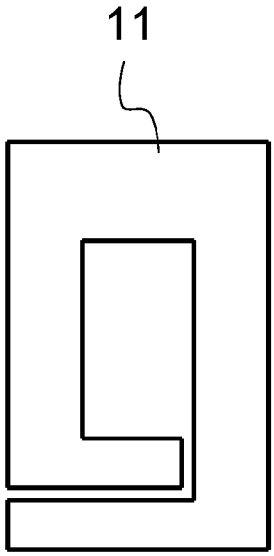
Figure 25C:
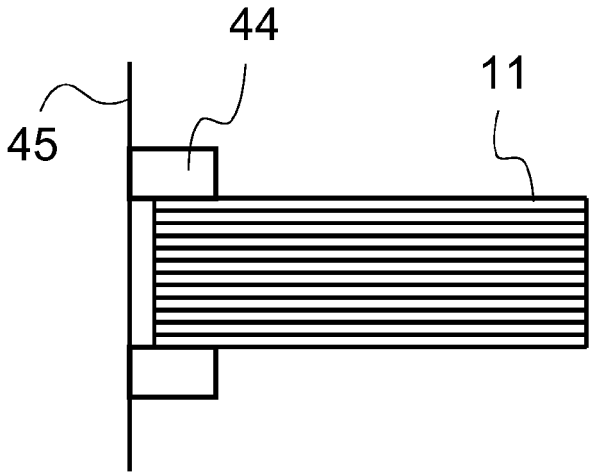
Figure 26:
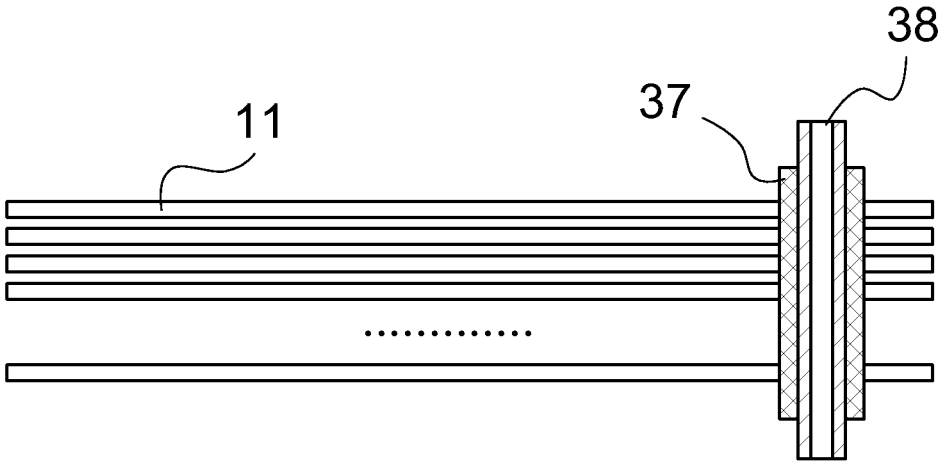
Figure 27:
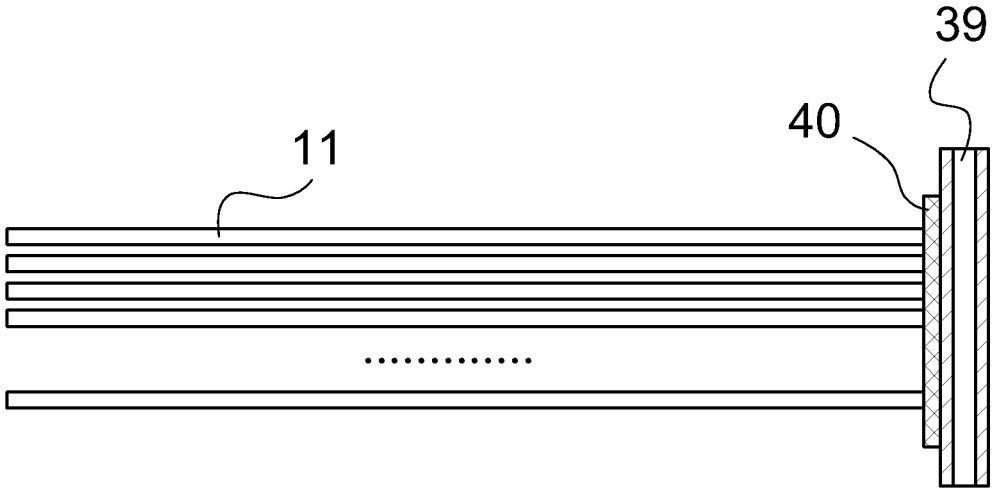

In the following, the invention will be described in detail by the aid of examples of its embodiments with reference to the attached drawings, wherein FIG. 1 illustrates a Prior Art choke with foil windings, FIGS. 2-5 present cross-sectioned, simplified and diagrammatic side views of different stacked winding structures, FIG. 6 presents a cross-section, simplified and diagrammatic side view of a choke according to the invention, FIGS. 7-9 present a cross-section, simplified and diagrammatic top view of different winding sheets for stacking, FIG. 10 presents an oblique, simplified and diagrammatic top view of another choke with the winding arrangement according to the invention, FIG. 11 presents a simplified and diagrammatic top view of a group of winding sheets for stacking, FIG. 12 presents a simplified and diagrammatic front view of the winding sheets of FIG. 11 as stacked, FIGS. 13-14 present a simplified and diagrammatic top view of a continuous strip for folding as a stacked structure, FIG. 15 presents a simplified and diagrammatic side view of one method to connect stacked winding sheets together, FIG. 15*a* presents a detailed cross section of a stacked winding according to the invention, FIG. 15*b* presents schematically one advantageous manufacturing process of the stacked winding according to the invention, FIG. 16 presents a simplified and diagrammatic top view of a special purpose winding sheet, FIG. 16*a* presents a simplified and diagrammatic side view of a special purpose winding sheet of another type, FIG. 16*b* presents in oblique view an alternative way to place the sheet connections in an inductive component, FIGS. 16*c*-16*f* present in oblique view winding sheets with connection projections bended in different directions, FIGS. 17-19 present a simplified and diagrammatic front view of different winding sheet structures with air gap, FIGS. 20-23 present an oblique, simplified and diagrammatic top and side view of different liquid cooling structures, FIG. 24 presents an oblique, simplified and diagrammatic top view of a choke with a liquid cooled winding according to FIG. 23, FIG. 25 presents a simplified and diagrammatic back view of a choke with a stacked winding with liquid cooling elements, FIG. 25*a* presents oblique view an alternative structure for a liquid cooled winding, FIG. 25*b* presents in top view a simple winding sheet for lower currents, FIG. 25*c* presents in side view an alternative compression structure for winding sheets, and FIGS. 26-27 present a cross-section, simplified and diagrammatic side view of different liquid cooled winding structures.

The winding structure according to the present invention relates specially to a high power planar winding, which is also called here "the stacked winding". The main idea of the present invention is that the winding that consists of planar, sheet like winding elements is provided with cooling medium that transfers excess heat away from the winding. According to the present invention the cooling medium can be gas or liquid and it is located between winding layers consisting of one or more winding sheets. Cooling medium can also be a solid substance on the surface of a winding sheet or it can be winding sheet itself when the cooling substance is inside winding sheet.

Figure 2:
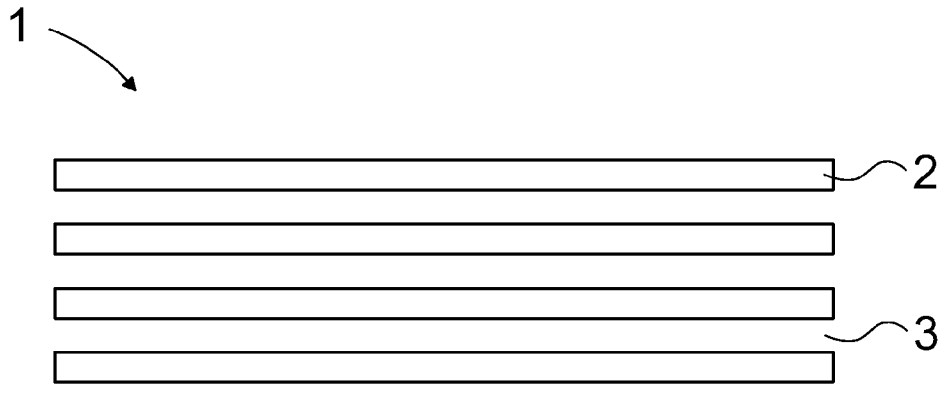

In FIG. 2 that presents the first embodiment of the invention the winding layers 2 of a winding 1 consisting of planar winding sheets have a space 3 such as a gap between them where air is blown for example by using a fan resulting an enhancement of the cooling by the moving air. The fan can be separate or integrated with the inductive component. The cooling medium circulated in the gaps 3 can be any other gas as well. The cooling can be based on the natural convection as well. In such a case the heat transfer is based on the movement of the heated air or gas and a separate fan is not needed. When using the natural convection principle it is optimum to mount the winding sheets in a vertical direction. Correspondingly when using a forced air cooling it is beneficial to provide the winding 1 with air guiding elements that steer the air to flow between the winding layers 2. The winding sheets can also be provided with specific bulges and other shapes that increase the turbulence of the air, which enhances heat transfer from the winding layers 2 to the cooling medium. One effective method is to block direct airflow in a specific gap 3 and make holes between the layers at the same spot. The air cannot then move in a laminar way between the layers but it will move through the holes from one side of the winding sheet to another side of the winding sheet, and at the same it becomes turbulent and it transfers heat effectively.

Important is that the winding arrangement according to the invention is realized so that the structure itself allows the movement of the cooling medium and handles the guidance of the cooling medium through as short and optimum path as possible to the required spaces in order to cool the winding structure and the core effectively. The effective guidance of the cooling medium works in all conditions but especially effective it is in the case of the forced air cooling. In a solution according to the preferred embodiment at least a part of the path of a cooling medium is steered to flow inside the winding structure.

Figure 3:
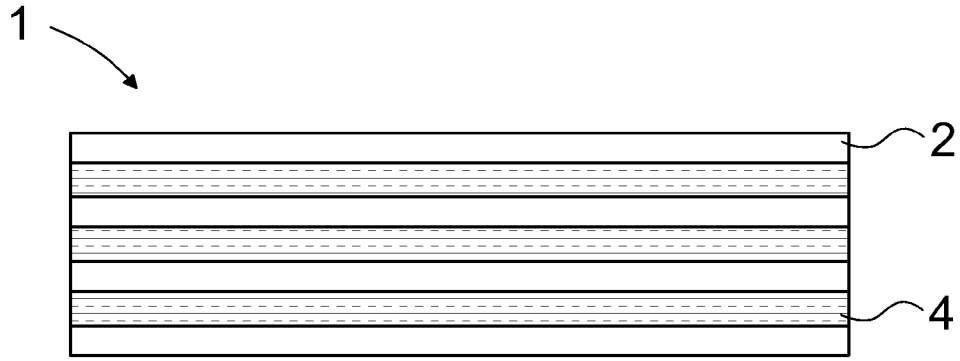

In the second advantageous embodiment presented in FIG. 3 the space 4 between winding layers 2 or on the outer surfaces of the winding layers 2 consisting of planar winding elements are provided with liquid cooled cold plates, which have cooling liquid circulation inside them. Also the winding sheets themselves can be designed in such a way that they act as cold plates. In other words they have a space 4 between the winding layers 2 where cooling liquid can circulate between the winding layers 2 or even inside the winding layers. When separate cold plates separated and insulated from the winding layers are used some impurities can be allowed in cooling liquid because a cooling liquid directly inside the winding sheets would require usage of electrically non-conductive cooling liquid. In practice cold plates are not needed between the every winding layer but only between every so many layers that the winding hotspot is in a proper temperature.

In a third advantageous embodiment of the invention shown in FIG. 4 the space 5 between the winding layers 2 and/or on the outer surface of the winding layers 2 is provided with a thermal conductor, which conducts heat by conduction away from between the winding layers 2. For example a thin insulated copper sheet that is fixed to the heat exchanger 6 with one of its sides can be placed between the winding layers. This will conduct heat away from the winding layers 2 along with the copper to the heat exchanger 6. Another effective heat conductor is graphite. Also ceramics such as aluminum oxide can be used as heat conductors. In such a case the thermal conductor is also acting as insulator between the winding sheets and it doesn't need a separate insulation.

Yet in another advantageous embodiment the winding has been designed in such a manner that when compressed together the heat will conduct effectively enough to the edge of the winding structure along with the winding sheets themselves. In other words the winding structure is self-cooling.

The winding sheets can be insulated by using coatings or by anodization or there can be a separate insulator between the winding layers. Especially for aluminum winding sheets anodization can be used as an insulator. The insulator can also be manufactured by cutting for example from Nomex-paper and it can be glued to a winding layer or it can be mounted mechanically. Such an insulator can also be used to provide touch protection when the outer edge of the insulator is brought over the edge of the winding sheet.

The insulator can also be secured against the winding sheet by using rivets or other similar elements. Insulators on the winding sheets can be used with any of the previously mentioned embodiments of the innovation.

A solution shown in FIG. 5 is yet another economic and efficient winding arrangement according to the invention. In this solution there is always two winding layers 2 insulated by an insulator 7 together and between these kind of structure there is a gap like space 3 for cooling air or other cooling medium. In this manner the structure becomes flatter but still each winding layer 2 is in contact from its one surface with the cooling medium being in the gap 3.

In practical winding structures above mentioned alternatives can be combined together.

FIG. 6 shows a cross-section, simplified and diagrammatic side view of a choke 8 equipped with the winding arrangement of the present invention, the choke consisting at least of a core 9 and a winding structure 10 placed around vertical core poles 9*b*. When the core poles 9*b* are in a vertical direction the winding sheets 11 of the winding structure 10 are placed around the core poles 9*b* one upon the other in the direction of the height of the core poles 9*b*. More generally it can be said that the winding sheets 11 are placed around the core poles 9*b* one after the other in the direction of the length of the core poles 9*b*, and more precisely the winding sheets 11 are placed around the core poles 9*b* one after the other in the direction of the magnetic flux in the core poles 9*b*. This kind of structure resembles a helical structure around the core poles 9*b*. That kind of helical structure can be seen also later in FIG. 17. The choke 8 in FIG. 6 has the same conductor cross sectional area, winding turns and core cross sectional area as in the prior art choke with the foil winding shown in FIG. 1.

When chokes of FIGS. 1 and 6 are compared together it can be noted that the choke 8 according to the invention can be made flatter and more cube like than choke in FIG. 1. This is optimum shape for size minimization. With the foil winding a thin foil must be used in order to minimize the skin and proximity effects and also from manufacturability reasons. This results a wide foil for a given conductor cross sectional area, which in turn makes the choke high. The vertical core poles of such a choke are high as well, which results an expensive choke. Also the problem is that the absolute power loss generated in the high core vertical poles is high because the chokes have the same power loss density. With the choke 8 according to the invention, which corresponds to the prior art choke according to FIG. 1 the vertical core poles 9*b* are about a half shorter than the vertical core poles of the choke of FIG. 1, which reduces cost and absolute power loss generated in the vertical core poles. This is especially beneficial in cases where vertical core poles 9*b* utilize more expensive and lower loss material and where horizontal bars 9*a* utilize less expensive and higher loss material. When the same core material is used in the vertical core poles 9*b* and the horizontal core bars 9*a* the minimum cost is achieved when horizontal and vertical bars are of same length. When different materials are used the optimum ratio of the lengths depends on the cost ratio of the materials. It can also be concluded that by using a choke according to the invention the power density of the power electronics equipment can be increased because the choke can be compressed to be 2-3 times smaller than prior art chokes due to it's better cooling performance and still it can handle the same throughput power. In the choke according to the invention the so-called hot spots are also eliminated because cooling medium can cool every point in the winding due to the winding structure. Because the lifetime of the insulator is temperature dependant this increases the reliability of the choke.

The choke using a winding according to the invention can be easily optimized to given geometrical constraints since the shape of the winding can be freely designed. For example both vertically long and horizontally long chokes can be designed easily while with traditional technology optimum solution is always vertically long.

The winding can also be manufactured by stacking so called sheets also called substantially planar and plate like winding elements that are later called the winding sheets on top of each other, or by folding a continuous patterned strip into an accordion like structure. It is beneficial to use rotationally symmetrical winding sheets. By doing so only one type of sheet is needed for manufacturing of the continuous winding structure when sheets on top of each other are connected together in a certain manner into a continuous structure.

In FIG. 7 is presented a winding sheet 11 for a single phase winding, the form of the winding sheet being for example like an angular S letter. When the winding sheets 11 of FIG. 7 are stacked on top of each other and every second sheet is rotated side ways around a continuous winding structure is generated. Also the winding sheets 11 are contacted together downwards from one edge and upwards from other edge. Such a winding sheet 11 is economic because it can be manufactured almost without material waste when mechanical dimensions are set so.

In FIGS. 8 and 9 a winding sheet 11 for a winding is shown. The winding sheets 11 of FIG. 9 are shorter than those of FIG. 8. In such a case the contact areas of such sheets of different length stacked on top of each other are not on top of each other either and the same structure can consist of multiple separate windings. In each figure the winding sheet on the right is a mirror image of the winding sheet on the left mirrored along with the vertical axis of the winding sheet 11. The winding sheet 11 is shaped as an O-letter with sharp corners. By stacking such winding sheets 11 and by mirroring every second sheet in a horizontal plane a continuous winding structure is formed when sheets are connected together in a certain way. In the figures the connection areas are at the bottom. With the winding sheets 11 also multiple turns can be formed on a layer before a movement to the next layer is done.

The winding sheets 11 can be manufactured by using a water or laser cutting, with a sheet metal processing station or with a follow-on-tool for punching. Especially the use of aluminum for the sheets is cost effective. Also it is possible to select always the most suitable material for different environmental conditions. Also the winding sheets 11 can be connected together by screwing, riveting, cold welding, pressing, welding, friction welding or any other known connection technology. The winding sheets 11 can also have specific cutting-ins and holes or dimples for connection elements, which makes it possible to compress the structure completely together yet to use connection elements that are thicker than the sheets itself.

The inner and outer edges of the winding sheet 11 may have any shape. In FIG. 9 a rectangular sheet is shown but the sheet might be also round, triangle or any shape. Inner and outer shapes may also be different. For example the inner shape may be round and outer shape rectangle. Also sheet corners may have roundings or bevels. It is very economical to manufacture winding sheets using a standard sheet metal processing and to use a compression for sheet connections.

In FIG. 10 it is shown a simplified 3-phase choke 12 that uses the winding arrangement according to the invention. For the sake of clarity the air gap between the winding layers is not shown. The choke 12 uses forced cooling air as a cooling medium. When liquid or other separate cooling elements are used different windings may share one or more heat exchangers. The structure has effective cooling because the winding consisting of the winding sheets 11 and the core 9 have an appropriate gap for cooling air movement between them. In other words the winding itself is steering the cooling air to the right places of the winding and the core. The winding structure may have in addition to the gaps at the sides of the winding a few larger gaps where more air can flow in order to cool the core. With the gaps like these the pressure drop caused by the choke can be adjusted.

In FIG. 11 a group of winding sheets 11*a*-11*d* intended for stacking is shown. Sheets 11*a* and 11*d* are similar except that as stacked they are mirrored along with their longitudinal axis. Also the winding sheets 11*b* and 11*c* are similar to each other except that as stacked they are mirrored along with their longitudinal axis. The width of all the winding sheets 11*a*-11*d* is essentially the same and also the height of all the winding sheets is essentially the same. In addition the projections 11*e* intended for the connection are at the same location and are of same width. Also the possible other projections and holes are located so that they align on top of each other in the stacked sheets.

FIG. 12 presents a simplified and diagrammatic frontal view of the stacked winding sheets 11*a*-11*d* according to FIG. 11. The winding sheet 11*a* is at the bottom and the winding sheet 11*b* is placed exactly above it. By so the stacked winding sheets 11*a* and 11*b* form the first layer of the winding structure, which builds one winding turn. In the layer there are two stacked winding sheets one upon the other in order to gain enough cross-sectional area. In a similar manner the winding sheets 11*c* and 11*d* build the second layer of the winding structure when they are stacked one upon the other. The first and second layers are connected at area B resulting two layers that are connected with each other. Between the layers there is always an insulator, which is absent only at the contact point.

When the winding structure is built the layers are build one upon the other in the way as described above and by contacting layers at the areas A and B in turn. In the structure shown in FIG. 12 the connection is done in the area B shown in FIG. 11. For the sake of clarity the parts of the winding sheets that are connected together are drawn in FIG. 12 with a continuous line while the rest of the sheet structures are drawn with a dotted line. In FIG. 12 the front surface 11*f* of the winding sheets is towards a viewer. It can be seen that in the structure where the structure according to FIG. 12 repeats continuously there will be space for the heads of the mounting elements for example on the bottom surface of the winding sheet 11*a* and on the top surface of the winding sheet 11*d*.

In some cases it is beneficial that winding sheets are designed in such a way that the previously mentioned connection points are in the same location. In other words connections are made in one spot. A connection element will go through the sheets to be connected together in that location.

Especially when small components are manufactured it is efficient to use welding or soldering as a winding layer connection method. In this connection the winding sheets placed one upon the other are welded together with their first ends or with their first sides.

Another effective method especially for low current winding manufacturing is to fold it from a continuous conductor strip. When the conductor strip 13 according to FIG. 13 is folded along with the dotted lines a continuous winding structure is build-up. The conductor strip may be totally or partially coated with an insulator or the insulator can be placed between the folded gaps. The strip 13 may also have projections where cables can be connected or which can be used for soldering to a printed circuit board. The conductor strip 13 shown here with its core holes 13*a* is suitable for such a core where the winding turns around two core poles. For example a U-core is such a core. In this structure each winding layer makes one turn. Some of the strip parts that meet other strip parts after the folding may be compressed or joined together in order to increase conductor thickness at that point.

In FIG. 14 there is shown a conductor strip 14 that has multiple different conductor strip parts and holes 13*a*, 14*a* for different kind of cores. With such a strip a winding for two or more chokes can be manufactured simultaneously without a connection between the two windings. This is usable for example with LCL-filter. Detailed shapes of the winding strips can be different from what is shown here and before. For example the hole 13*a*, 14*a* reserved for the core could be round.

In FIG. 15 it is shown one method to connect the winding layers together. Here the compression joining is used. A threaded bar 15 with a compression spring 16 at its top end penetrates through the stack of the winding sheets 11. In order to adjust compression the bar 15 has a screw thread at its top end and a nut 17 acting as adjustment means. With such a structure a reliable connection can be built that for example compensates mechanical stresses and movements caused by thermal expansion. Alternatively to the spring different compression elements such as spring washers can be used.

Compression of the winding stack connection areas is secured against thermal expansion and mechanical stress by using "springs" in series with compression elements. Compression elements must have low dimensional changes against temperature changes. For example a metal bushing is such an element. Such a metal element must be insulated from the metallic winding by using one or more insulation layers. FIG. 15*a* presents a detailed cross section of a stacked winding. In FIG. 15*a* the washers or spacers 22*c*, 22*d* and bushings 22*e* are metal and there is an insulation layer 21 or layers between the winding sheet 11 and the lowest spacer 22*d*. Alternatively spacers and/or bushings could be insulators but important is that they are mechanically stable against temperature, pressure and time. For example ceramics is mechanically stable insulator while plastics has problems with mechanical stability under high pressures in high temperatures. In the solution shown in FIG. 15*a* the compression of the sheets 11 has been implemented with threaded bars 22, nuts 22*a* and both spring washers 22*b*, spacers 22*c*, metal bushings 21 and connection parts 11*a*.

FIG. 15*b* shows schematically one advantageous manufacturing process of the stacked winding. It is beneficial to remove oxidation from the surfaces of the sheets 11 by chemical or mechanical means before the sheets 11 are stacked and compressed together. The removal is done in step 41*a*. The stacking phase 41*b* must be done shortly after the oxide removal so that a new oxide layer doesn't grow to that surface. The next step 41*c* is the compression of the stack. If the surface is grinded to have some roughness such roughnesses will penetrate through the oxide layer due to the thermal expansion during the manufacturing process, testing and operation. Also for a long-term reliability of the connections it is beneficial to protect the winding and particularly the connection areas with a varnish or similar. It is beneficial to use a varnishing process where assembled winding is first dipped into a resin in step 41*d*, and then heated in step 41*e* to approx. 150° C. and then cooled down and tested for winding resistance in step 41*f*. During such a process the varnish layer will solidify around the winding due to temperature at the same time when surface roughnesses will penetrate through a possible thin oxide layer formed after the grinding and before the stacking due to thermal expansion forces. This results a low contact resistance with a high long time stability.

The winding layers may consist of multiple stacked thinner sheets. This may be needed for example due to manufacturing constraints such as a limited availability of different sheet thicknesses or a limited cutting capacity of available cutting techniques. Also for a high frequency operation it is beneficial to use multiple thinner sheets because at high frequencies the current flows only at the surface of the conductors and multiple thin sheets have larger total surface than one thick sheet. The winding arrangement according to the invention is suited for example for manufacturing dudt, LC, LCL and harmonic chokes and transformers. Stacked windings can also be combined with other winding types such as a foil winding and a wire wound in the same inductive component.

In FIG. 16 there is shown a specific winding sheet 11 that is also called a bus-bar sheet, which has a projection 18 for the cable connection. Such a winding sheet can be used as the first and the last sheet in the winding so that cables can be connected to them. Bus-bar sheets like these can also be used for intermediate connections inside the winding for example to adjust the winding for different voltage ranges. Also such a projection 18 can be used for capacitor connections that result a compact structure.

In FIG. 16*a* there is shown another type of a winding sheet 11 or bus-bar sheet, which has also a projection 18 for the cable connection. Bus-bar extensions or projections 18 from a winding stack can be bended in any direction or any angle as needed for cable connections. The extension 18 of the bus-bar 11 is leveled slightly upwards from the principle winding layers. This can be done by doing some additional bendings 18*a* to the winding sheets 11.

FIG. 16*b* shows yet an alternative way to place the sheet connections in a choke. These are achieved as well with a suitable additional bending of the winding sheets 11 and a suitable shaping of the projections 18 of the winding sheets 11. In FIG. 16*b* some of the projections 18 are upwards and the others are sidewards.

Not only the bus-bar sheets but also any winding sheet 11 can be bended into different directions. This may be needed for example in order to utilize all three dimensions efficiently. An example of such a bended winding sheet 11 and resulting winding is shown in FIGS. 16*c* . . . 16*f*. FIG. 16*c* shows the winding sheet 11 that is bended from its sides. FIGS. 16*d* and 16*e* show how the bended winding sheets 11 are assembled together. First two bended sheets 11 where the projections 18 are upwards are put together so that they have the similar bus-bar connection or projection 18 but slightly different dimensions so that they fit together one inside the other. Then the other two bended sheets 11 where the projections 18 are sidewards are put together so that they have the similar bus-bar connection or projection 18 but slightly different dimensions so that they fit together one inside the other. Then these two pairs are connected together using connection holes, which can be seen also in 3D projection. This larger hole 42 is indented for a threaded bar 22, which compresses the winding stack together. Bended insulators 21 are also inserted into the stacked structure. FIG. 16*f* shows a complete winding with bus-bars having two projections 18 for connections and bended sheets 11. As can be seen such a winding is very narrow and utilizes available height effectively.

In FIG. 17 an alternative method for the winding layer connection is presented. The winding sheet 11 itself is symmetrical and the connection between winding layers is done by using a separate connection part 19 so that the connection part 19 connects the places to be connected by using compression. The places that shall not be connected will be insulated from each other or kept in a distance from each other by using a gap forming space 20. On the right hand view of FIG. 17 that is a the frontal view, four winding sheets 11 have been assembled together one upon the other using three connection parts 19. In each connection the right hand front part 11*g* of the upper winding sheet 11 and the left hand front part 11*h* of the lower winding sheet 11 have been connected with the connection part 19.

Forming of the turns can be explained in more detail as follows. Each winding sheet 11 has its both ends between the connection parts 19 and the ends are bended up and downward so that connections are made to either upper or lower connection part 19. By this way a continuous winding is constructed.

When air gaps are to be implemented between each winding layer by using a space 20 the described winding sheet 11 or similar and the connection part 19 are used between the winding sheet layers in the first end of the structure. Similarly at the other end of the structure between the winding sheets 11 there may be spacers with threaded bars 22 with the thickness corresponding to the thickness of the connection part 19. On the right hand side of FIG. 18 it is shown how the winding sheets 11 and the connection parts 19 are assembled upon each other as a stack in the way that an insulator 21 is placed between the layers so that the areas that are not to be connected together are separated. For example when a winding sheet 11 shaped but slightly larger insulator 21 is used the ends of the insulator can be placed on the opposite sides of the connection part 19. The winding assembly is compressed together by using threaded bars 22 placed through the holes in the winding sheets 11. The insulators can be separate smaller insulators or a single bigger insulator, which is perhaps bended in different layers in the winding structure in different places.

In FIG. 19 the winding structure is shown where the winding layers are from one side fastened to another winding layer and from other side in contact with the space 20 forming an air gap. As already earlier explained this reduces the height of the winding stack. In such a case the winding assembly is assembled by placing always two winding sheets 11 upon each other in a manner that one of them is mirrored and by placing on a top of them a connection part 19. With a suitable insulator 21 the structure can be achieved where contacts between the layers are done in such a way that a continuous winding structure as shown in the figure on the right is built. The mentioned two winding sheets 11 are in contact with each other in the middle of the structure and the connection part 19 makes a contact to the upper layer on one end and to the lower layer on the other end.

Figure 20:
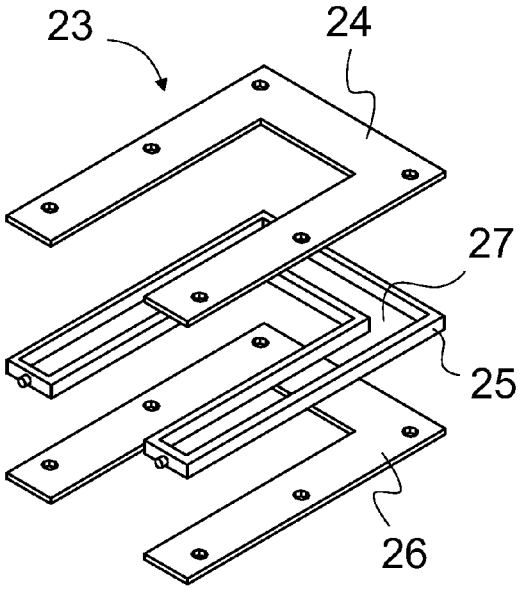

In FIG. 20 there is shown a simplified structure of a planar liquid cooling element 23. The liquid cooling element 23 consists of bottom- top- and middle sheets 24-26. When the sheets are connected as a stack a cavity 27 is formed for liquid to flow in. The liquid cooling element 23 can also by built using alternative methods such as aluminum extrusion or by soldering from thin sheets. The middle sheet 25 that forms the cavity for liquid to flow can be manufactured from a different material than other parts 24 and 26 of the element. In such a case the middle sheet 25 can for example be partly or completely of gasket material. With the structure of FIG. 20 the liquid cooling cold plate can be effectively integrated into the stacked winding structure. The structure of FIG. 20 can also be used as a winding by adding suitable elements into it.

The liquid cooling element 23 can also have multiple sheet layers that makes it possible to build a 3-dimensional liquid flow. This makes it possible to make the liquid flow turbulent that makes the cooling more efficient. In FIG. 21 an alternative equivalent structure is shown where a sheet 28 has holes in it. This makes it possible for the liquid to spray directly into the bottom 29 and/or the top plate 30, which enhances the heat transfer.

In its simplest form the liquid cooling heat exchanger or the liquid cooling element 23 can be as shown in FIG. 22 cross-sectioned by end and side projections, an essentially rectangular object 31 where in the middle of the object there is a longitudinal space 32 such as a hole or holes for the cooling liquid to flow. Extrusion technology is well suited for manufacturing these kinds of elements 23.

FIG. 23 shows a winding element 33 stacked from the winding sheets 11 where the winding sheets 11 are placed into the middle of the liquid cooling elements 23. Further in FIG. 24 a complete 3-phase choke 34 is shown where the winding structure is build from the multiple liquid cooled winding elements 33. Also the core 9 could be cooled with liquid by utilizing the holes or grooves in the cores for liquid tube insertion. The liquid cooling flow could also be only in the core and the winding could be cooled into it.

In FIG. 25 there is shown one liquid cooled winding structure according to the invention seen from the first end in a simplified form. Layers are also partly separated in the figure in the vertical direction. For the sake of clarity the winding sheets are drawn only in the part where contacts are built. In other words FIG. 25 is similar to FIG. 12 but parts drawn with dotted lines have been left away from FIG. 25. The other end of the structure may be different for example so that all the winding sheets 11 are of the same thick and they are placed on top of each other in such a way that there is no big gaps or no gaps at all between the layers.

In the first end of the structure shown in FIG. 25 there are contacts between the winding sheets 11 and that is why there must be more space between the winding layers for example for the heads of the connection elements 37 such as screws or bolts. Each winding layer 35 consists of two winding sheets 11 in a similar way as shown in FIG. 12. Each layer builds one winding turn and layers are insulated from each other everywhere else but at their contact points. In order to reduce a contact resistance all the winding sheets 11 that are to be contacted are grinded in order to remove the oxide layer and compressed together and riveted, bolted or other wise connected together at two different places so that a large contact area is formed. The two topmost and bottom most winding sheets 11*i* of the structure reach in the inner dimension to a different length than the innermost winding sheets 11, thus between the winding layers 35 enough space is formed where the insulator 21 can be and can bend. Also a space is formed for the rivet heads. The shape of the topmost and bottommost winding sheets 11*i* is for example the same as the shape of the winding sheet shown in FIG. 16 or such that instead of the direct projection 18 the projection can bend 90 degrees toward the center line of the sheet.

Between the winding layers 35 the liquid cooling elements 23 have been placed into suitable locations, and the winding sheets 11*j* situated below and above the cooling elements have at the first end extra projections 36 directed towards the sheet center line and bended obliquely either upwards or downwards in such a manner that winding sheet layers 35 can be connected while bypassing cooling elements 23. In the winding layers 35 above the cooling element 23 the projections 36 are bended downwards and in the winding layers 35 below the cooling element 23 the projections 36 are bended upwards. The connection is formed by connecting the downwards and upwards bended projections 36 to each other with fastening means like rivets or bolts. The bypassing of the cooling element 23 could also be done with alternative methods such as with a conductive part whose thickness is the same as the thickness of the cooling element.

At the ends of the liquid cooling elements 23 there are connections 38 for the liquid passages by the help of which the liquid cooling elements are connected to each other in order to make a circulation for the flow of the cooling liquid. For the sake of clarity the liquid cooling tubes are not shown in FIG. 25.

An alternative structure for a liquid cooled winding is shown in FIG. 25*a*. The main idea here is that the winding sheets 11 are planar and connections between the winding sheets 11 in layers and turns are done by utilizing compression alone. An additional conductor part is utilized in order to provide a current conduction path and a contact over the cold plates. Such a winding is easier to assemble than the previously presented version.

The winding structure is composed e.g. of the winding sheets 11 described above. The winding sheets 11 are stacked into one stack, one upon the other. Heat exchangers 23, in which cooling liquid flows and which function as liquid cooling elements, are placed at suitable gaps of the stack between the winding sheets 11. This kind of assembled pack is pressed together with the threaded fixing bars 22 and 22*f*, which also interposition the winding sheets 11, the insulators 21 and the liquid cooling elements 23. When the bars 22 and 22*f* compress the structure, electrical contacts and heat transfer contacts between the different layers are created at the same time. In this case e.g. the bars 22 are specifically for heat transfer contacts and the bars 22*f* for electrical contacts. The bars 22 and 22*f* are insulated from the winding sheets 11 by means of insulator pipes 43.

The winding according to the invention is in the thermal contact with a cold plate from the most of its area while a prior art foil winding is in the thermal contact only from a very small area.

For lower currents such as 50A-200A it is beneficial to use a simpler version of the sheet stacking. One suitable sheet 11 is shown in FIG. 25*b*. Such simple sheets are insulated from appropriate places for example by using tape, coating, paint or anodization or a similar method and are stacked together by rotating every second sheet by 180 degrees. In this way a continuous winding structure builds up.

FIG. 25*c* shows how the stack can be formed by compression to build the connections, and layers may be secured together with additional means such as gluing, impregnation, compressive elements, soldering, welding or laser welding. The structure has a base plate 45 equipped with special compressing parts 44 that compress the winding sheets 11 between themselves forming a winding stack.

In FIGS. 26 and 27 there are shown two alternative solutions for cooling the winding with liquid. In the pipe solution according to FIG. 25 one or more insulated tubes 37 penetrate through the stack formed by the winding sheets 11. For example a ceramic tube is suitable for this. In order to increase reliability a normal aluminum tube 38 can be placed inside the ceramic tube 37. An alternative solution is shown in FIG. 27 where a heat exchanger 39 is at the side of the winding structure behind a separate insulator 40.

The winding structure according to the invention is also beneficial for the short circuit strength. During a short circuit large currents flow in windings and large forces are present. These forces may easily deform the prior art foil winding. The winding according to the invention has the better strength against short circuit currents because winding layers are in the direction of the winding pole. In the prior art foil winding the winding layers build in the direction of 90 degrees from the winding pole and the resulting force is larger. Also the rounding of the sheet corners results better mechanical strength against short circuit currents.

It is obvious to the person skilled in the art that different embodiments of the invention are not limited to the examples described above, but that they may be varied within the scope of the claims presented later.

The invention claimed is:

1. Winding arrangement for an inductive component, which inductive component comprises at least a core and a winding formed around the core and consisting of essentially planar winding sheets, wherein the winding consists at least of series connected winding layers that consist of the stacked winding sheets, for which series connection the contact areas of the winding layers are contacted electrically and/or insulated by compression, which electrical connection between the winding layers is formed by a connection part located between the winding layers and/or projections extending from the winding sheets, which compression is generated by at least one bar that penetrates through the winding sheets, which bar is electrically insulated from the winding sheets.

2. Winding arrangement according to claim 1, wherein some winding sheets are in contact with cooling medium flowing between the winding sheets.

3. Winding arrangement according to claim 1 or 2, wherein cooling medium is air and a space for airflow between the winding sheets is made with a connection part, which connection part is in compression inside a winding stack, which connection part also makes the electrical contact between the winding sheets to be electrically contacted.

4. Winding arrangement according to according to claim 1, or 2, wherein the cooling medium is flowing at least on other surface of each winding sheet.

5. Winding arrangement according to according to claim 1 or 2, wherein the cooling medium is liquid that is flowing in cooling elements.

6. Winding arrangement according to claim 1, wherein some of the winding sheets have projections for cable connections.

7. Winding arrangement according to claim 1, wherein winding has been manufactured by removing the oxidation from surfaces of the winding sheets by chemical or mechanical means in step (41*a*) before the winding sheets are stacked in step (41*b*) and compressed together in step (41*c*), after which the assembled winding stack is first dipped into a resin in step (41*d*), and then heated in step (41*e*) to approximately 100 to 200C., advantageously approximately 150C., and then cooled down in step (41*f*).

8. Winding arrangement according to claim 1, wherein the removal of oxidation is made by grinding the winding sheets, after which the stacked and compressed winding, and particularly the connection areas are protected with a varnish or similar substance.

9. Winding arrangement according to claim 1, wherein the winding sheet has bendings.

10. Winding arrangement according to according to claim 3, wherein the cooling medium is flowing at least on other surface of each winding sheet.

11. Winding arrangement according to claim 2, wherein some of the winding sheets have projections for cable connections.

12. Winding arrangement according to claim 3, wherein some of the winding sheets have projections for cable connections.

13. Winding arrangement according to claim 4, wherein some of the winding sheets have projections for cable connections.

* * * * *